US005595148A

United States Patent [19]

Letsche et al.

[11] Patent Number: 5,595,148

[45] Date of Patent: Jan. 21, 1997

[54] HYDRAULIC VALVE CONTROL DEVICE

[75] Inventors: Ulrich Letsche, Stuttgart; Andreas Rehberger, Berglen; Frank Iberle, Karlsruhe, all of Germany

[73] Assignee: Mercedes-Benz AG, Stuttgart, Germany

[21] Appl. No.: 588,768

[22] Filed: Jan. 19, 1996

[30] Foreign Application Priority Data

Jan. 19, 1995 [DE] Germany ..... 195 01 495.2

[51] Int. Cl.[6] ..... F01L 9/02; F16K 31/363

[52] U.S. Cl. ..... 123/90.12; 137/906; 251/25; 91/356; 91/392; 91/508; 92/85 B

[58] Field of Search ..... 123/90.12, 90.13, 123/90.15; 137/906; 251/25; 91/275, 356, 392, 508; 92/85 B

[56] References Cited

U.S. PATENT DOCUMENTS

| | | | |
|---|---|---|---|
| 5,193,495 | 3/1993 | Wood, III | 123/90.12 |
| 5,287,829 | 2/1994 | Rose | 123/90.12 |
| 5,529,030 | 6/1996 | Rose | 123/90.12 |
| 5,531,192 | 7/1996 | Feucht et al. | 123/90.12 |

FOREIGN PATENT DOCUMENTS

3836725C1 12/1989 Germany .

*Primary Examiner*—Weilun Lo

*Attorney, Agent, or Firm*—Evenson McKeown Edwards & Lenahan, PLLC

[57] ABSTRACT

The invention relates to a freely activatable hydraulic valve control device for a stroke valve, which valve control device is arranged particularly in an internal-combustion engine. The stroke valve includes a valve stem and a first spring acting on the valve stem in the valve-closing direction as well as a second spring acting at least periodically on the valve stem in the valve-opening direction. The valve stem is connected at least to a control piston arranged in a working space and capable of being loaded on two sides with a working fluid. The pressure of the working fluid in the working space can be regulated via a pressure source together with a switching valve and a supply conduit. In order to improve further a hydraulic valve control device of the relevant generic type, it is provided that the prestressing force of the second spring is regulatable while the actuating arrangement is in operation and that, with the working fluid relieved of pressure in the working space and with the second spring contracted, the first spring holds the stroke valve in a closed position.

20 Claims, 3 Drawing Sheets

HYDRAULIC VALVE CONTROL DEVICE

BACKGROUND AND SUMMARY OF THE INVENTION

The invention relates to a hydraulic valve control device for a stroke valve for an internal combustion engine.

German Patent Document DE 3,836,725 C1 already discloses a hydraulic valve control device for a stroke valve, particularly for arrangement in an internal-combustion engine. A valve stem of the stroke valve is connected to a piston which separates two stroke spaces in a cylinder from one another which can each be connected to a pump for working fluid or to a reservoir via inlet and outlet ports capable of being covered by the piston. In order to lower the energy requirement of the actuating arrangement, the two inlet ports open in a middle actuating region of the piston are directly connected to one another by means of a conduit. Two oppositely acting compression springs engage on the piston or valve stem and, in equilibrium, hold the piston in a middle position with respect to its two end positions, as a result of which the valve is partially opened when the working fluid expands or when the internal-combustion engine is at a standstill.

In devices of the relevant generic type, valve pockets are provided in the piston by means of the valve which is partially opened in the non-actuated position of rest, or additional tension devices keeping the valve closed in the non-actuated position of rest are required.

An object on which the invention is based is to improve further a hydraulic valve control device of the relevant generic type.

This object is achieved according to the invention by providing a hydraulic control device for a stroke valve, which valve control device is arranged particularly in an internal-combustion engine, the stroke valve comprising a valve stem and a first spring acting on the valve stem in a valve-closing direction as well as a second spring acting at least periodically on said valve stem in a valve-opening direction, the valve stem being connected at least to a control piston which is arranged in a working space and can be loaded on two sides with a working fluid and by means of which, in a region of its end positions, in each case a pressure space belonging to the working space and separable hydraulically from the working space is partially limited, a pressure of the working fluid in the working space being regulatable via a pressure source together with a switching valve and a supply conduit and, in a region of at least one of two end positions of the control piston, the pressure space assigned to said at least one end position is capable of being relieved of pressure via a connecting duct, wherein the prestressing force of the second spring can be regulated while the valve control device is in operation and, with the working fluid relieved of pressure in the working space and with the second spring contracted, the first spring holds the stroke valve in a closed position.

One advantage of the device according to the invention is that the stroke valve is closed in the non-actuated position of rest. Thus, valve pockets in the piston or separate tension devices keeping the stroke valve closed in the non-actuated position of rest can be dispensed with.

In comparison with electromagnetic valve control devices, the hydraulic device according to the invention also has inter alia fundamental advantages, since heavy, large-size electromagnets necessitating high currents for the purpose of applying the corresponding control forces are dispensed with. In the valve-actuating device according to the invention, no consumption of pressure oil occurs during the valve movement, but only a relatively small internal stream of blind oil flows, this being advantageous particularly with regard to the valve control times and the energy consumption of the device. The supply of energy takes place automatically, predominantly in the closed position of the stroke valve.

A further advantage of the device according to the invention is that operations of catching and holding the stroke valve take place automatically. An excessive force for overcoming the gas forces in the cylinder of the internal-combustion engine (pushing-open work by the stroke valve) can be controlled via the pressure level of the oil-pressure spring.

If the valve drive and the oil-supply bores are integrated into the cylinder-head structure, the radial overall space can be reduced to such an extent that a diameter of only approximately 25–30 mm is needed for each hydraulic unit. Since the entire cam mechanism is dispensed with, a reduction in the overall space requirements for the valve mechanism is thus achievable.

One advantage of the variation in the prestressing force of the second spring in certain preferred embodiment is that on the one hand, the energy loss occurring essentially as a result of friction during the actuation of the device can be compensated by a retensioning of the second spring and, on the other hand, a reliable closing of the opened valve is achieved, in that a possibly excessive remaining prestressing force of the second spring can be reduced, so that the force of the first spring can reliably execute the closing movement.

In certain preferred embodiments, the second spring is an oil pressure spring, the oil pressure of which is controllable. In other preferred embodiments, it is contemplated to use a helical spring or the like instead of the oil-pressure spring, in which case the spring articulation point is, for example, cyclically displaceable, so that the prestressing force of this spring can be adjusted while the device is in operation. This can be carried out, for example, by means of hydraulic force transmission.

Other objects, advantages and novel features of the present invention will become apparent from the following detailed description of the invention when considered in conjunction with the accompanying drawings.

DETAILED DESCRIPTION OF THE DRAWINGS

Figure 1:
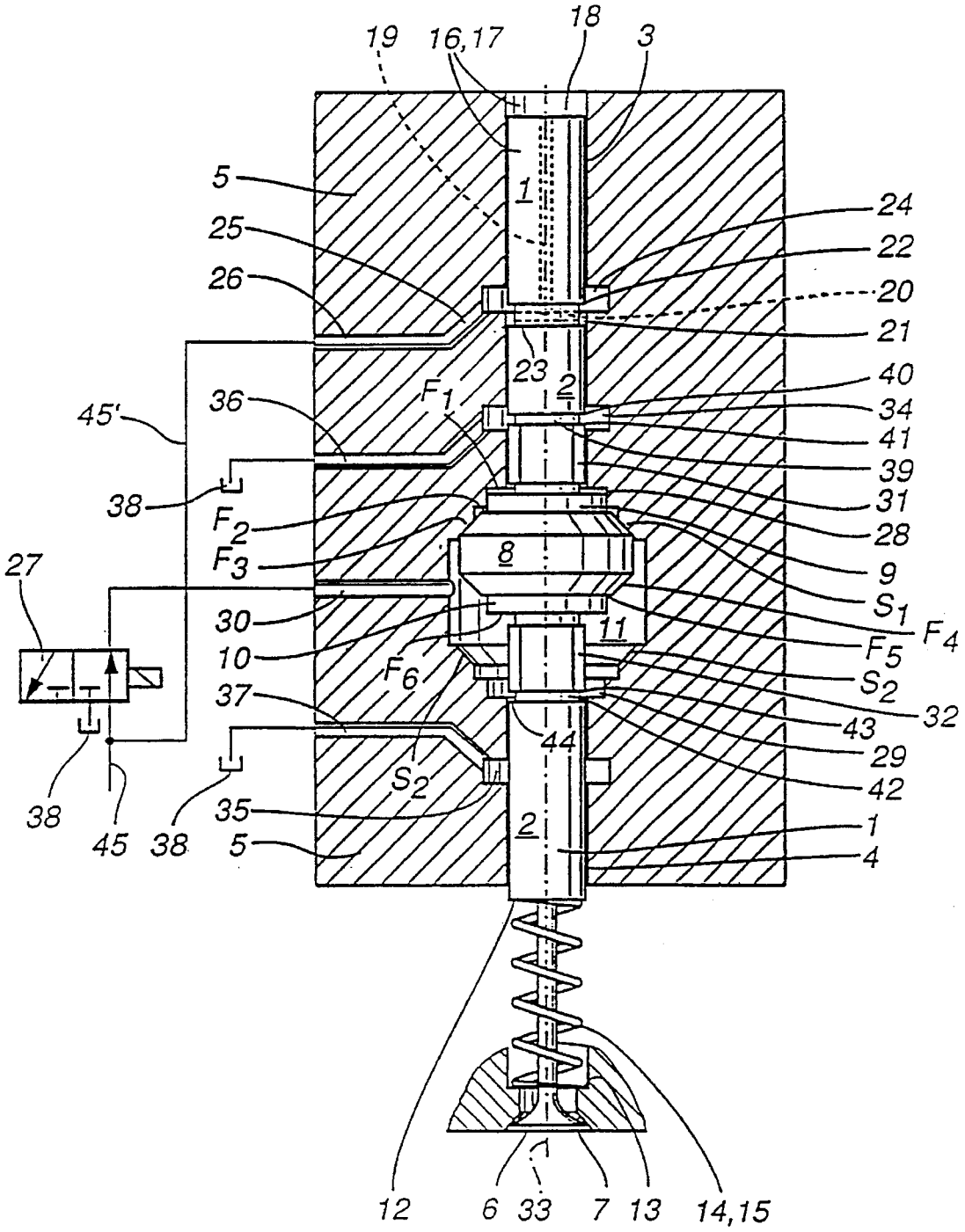
FIG. 1 is a schematic sectional view of a preferred embodiment of a hydraulically working, freely activatable valve control device in a housing of an internal-combustion engine, in a representation with the valve closed.
Figure 2:
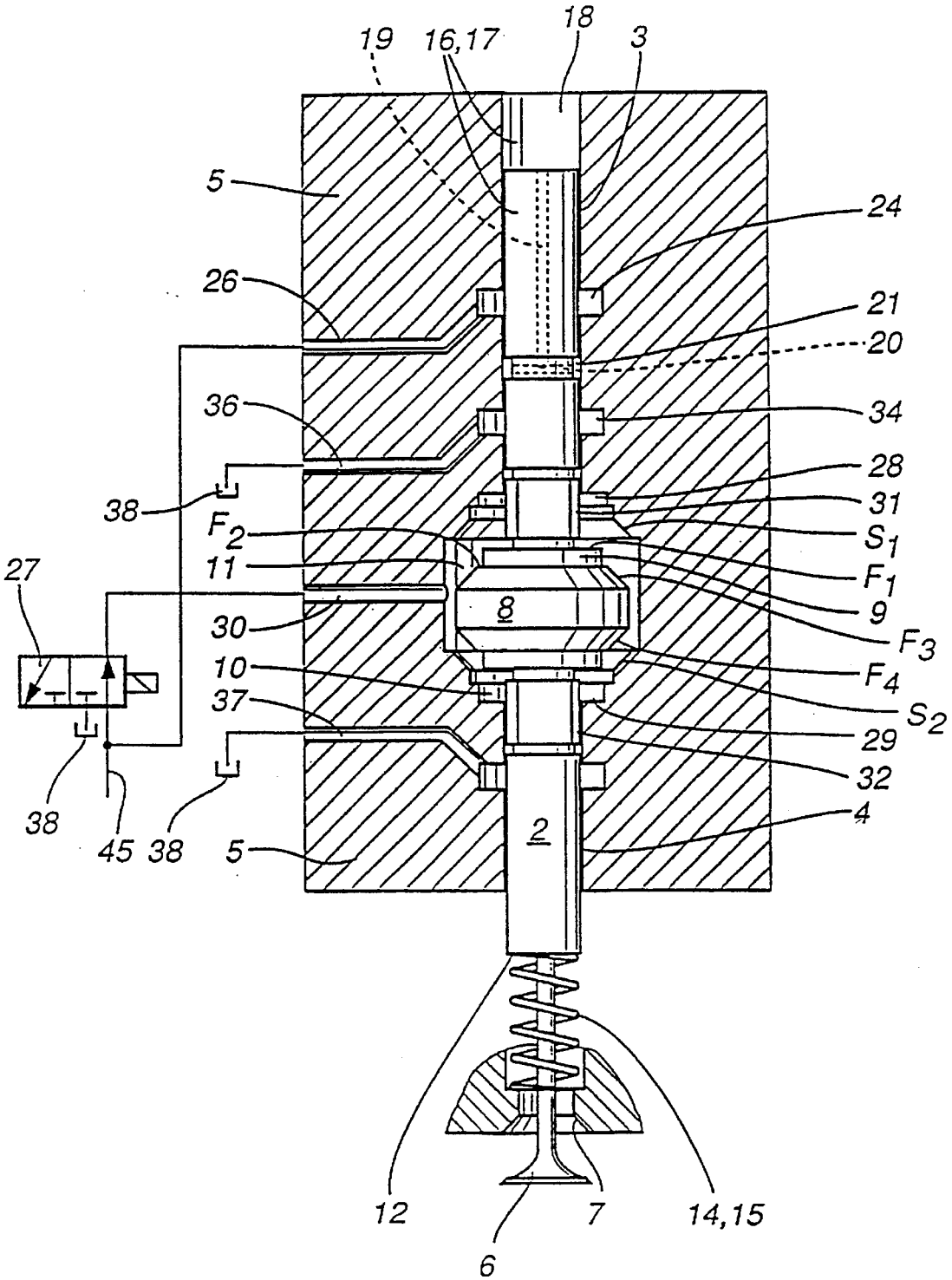
FIG. 2 shows the valve control device according to FIG. 1 in a representation with the valve partially opened.
Figure 3:
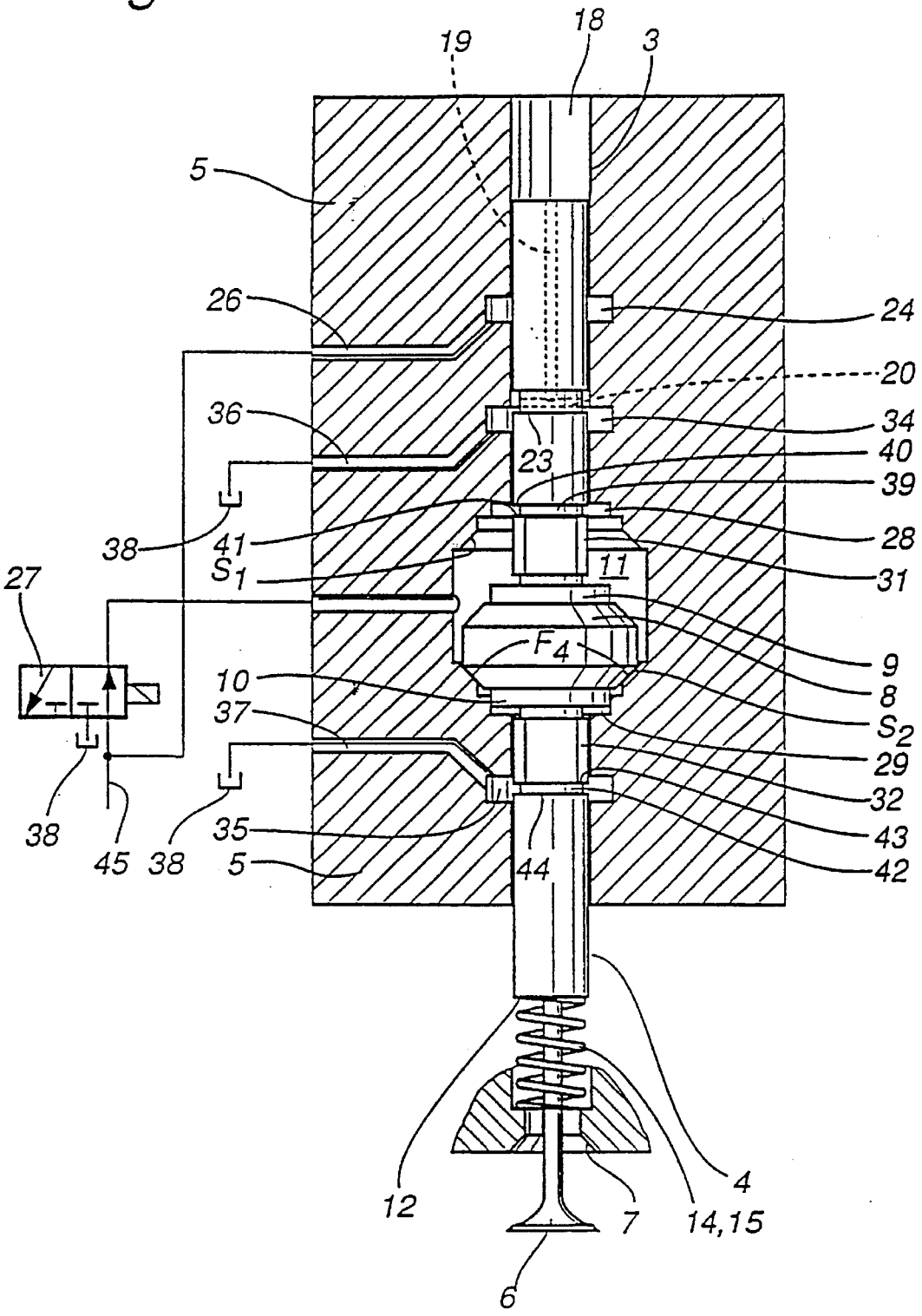
FIG. 3 shows the valve control device according to FIGS. 1 and 2 in a representation with the valve opened completely.

FIGS. 1 to 3 show a hydraulic, freely activatable valve control device having a stroke valve 1, together with a valve stem 2, which is guided in valve guides 3 and 4 in a housing 5 of an internal-combustion engine not shown in more detail.

The stroke valve 1 comprises a valve disc 6, together with a valve seat 7, and a control piston 8 which is described in more detail below and which is fastened to the valve stem 2.

The control piston 8 comprises two plunger pistons 9 and 10, the plunger piston 9 being fastened to the top side of the control piston 8 and the plunger piston 10 to the underside of control piston 8.

Arranged in the housing 5, between the two valve guides 3 and 4, is a cavity which forms a working space 11 for the control piston 8 together with the plunger pistons 9 and 10. The valve stem 2 passes through the working space 11, there being arranged between a spring receptacle 12 of the valve stem 2 and a spring receptacle 13 of the housing 5 a first spring 14 acting in the valve-closing direction. The spring 14 is a helical compression spring 15 which is supported in the spring receptacles 12, 13 and which is fixed to these receptacles.

Arranged on the side of the valve stem 2 facing away from the valve disc 6 is a second spring 16 which acts in the valve-opening direction and which consists of an oil-pressure spring 17. This oil pressure spring 17 comprises a stroke space 18 which is connected to a control groove 21 of the valve stem 2 by means of pressure ducts 19 and 20 extending in the valve stem 2, the control groove 21 possessing two control edges 22 and 23. The control groove 21 is periodically connected hydraulically in a way described in more detail below to a pressure duct 24 in the form of an annular groove, in the housing 5, the pressure duct being arranged around the valve stem 2 and being connected to a pressure supply conduit 45-45' via a duct 25 together with a conduit 26.

The working space 11 encloses the control piston 8 together with the plunger pistons 9 and 10, two pressure spaces 28 and 29 assigned in each case to a plunger piston 9 and 10 arranged in the working space 11. The plunger piston 9 can be plunged into the pressure space 28 in the region of the upper end position of the control piston 8 and the plunger piston 10 can be plunged into the pressure space 29 in the region of the lower end position of the control piston 8, with the result that the plunger piston 9 or 10 forms a partial limitation of the respectively associated pressure space 28 or 29.

Located in the working space 11 is working fluid (for example, lubricating oil or fuel), the pressure of which can be regulated via a pressure source (working fluid pump) (not shown) together with a switching valve 27 and supply conduit 30. In the region of the upper end position of the control piston 8, the pressure space 28 can be relieved of pressure into an annular pressure relief duct 34 via a connecting duct 31 (see FIG. 1), and in the region of the lower end position of the control piston 8 the pressure space 29 can be relieved of pressure into an annular pressure-relief duct 35 via a connecting duct 32 (see FIG. 3).

When the plunger piston 9 or 10 plunges into the pressure space 28 or 29, a hydraulic separation of the respective pressure space 28 or 29 from the working space 11 occurs. The control piston 8 together with the plunger pistons 9 and 10 can be loaded on two sides by the working fluid in the working space 11.

The control piston 8 is designed in such a way that, after one of the two plunger pistons 9, 10 has emerged from the associated pressure space 28 and 29, the working space 11 and the two pressure spaces 28 and 29 are hydraulically connected to one another, the hydraulic connection of the two pressure spaces 28, 29 being formed by the working space 11 itself.

The prestressing force of the second spring 16 (oil-pressure spring 17) can be regulated in a way described in more detail below while the hydraulic valve control device is in operation. With the working fluid relieved of pressure in the working space 11 and with the second spring 16 contracted, the first spring 14 (helical compression spring 15) holds the stroke valve 1 in a closed position (see FIG. 1).

The energy loss occurring during a movement cycle can be compensated by a cyclic variation in the prestressing force of the second spring 16 (oil pressure spring 17). With the stroke valve 1 closed, the working pressure of the oil-pressure spring 17 can be built up from the pressure supply conduit 45-45' via the pressure ducts 19, 20 and the control groove 21 via the pressure duct 24 in the form of an annular groove together with the conduit 26 (see FIG. 1).

When the stroke valve 1 is closed and its opening is intended, a reduction in the oil pressure of the working space 11 can be controlled via the supply conduit 30 by means of the switching valve 27. The switching valve 27 is connected on the one hand, via the supply conduit 30 to the working space 11 and, on the other hand, via the pressure supply conduit 45-45' to the working-medium pump and to the reservoir 38 of working fluid.

Hydraulically active surfaces F1–F6 of the control piston 8 are oriented perpendicularly or obliquely to a stroke-valve axis 33. Thus, by pressure loading, a force component parallel to the stroke-valve axis 33, the force component corresponding to the projecting surface fraction of the respective surface F1–F6, is generated. The hydraulically active surfaces F1–F6 of the control piston 8 together with the plunger pistons 9, 10 are of equal size in the valve-opening direction and in the valve-closing direction in a position lifted off from the end positions of the control piston 8. The surfaces F1/F6, F2/F5 and F3/F4 are of equal size and are arranged symmetrically with respect to a plane perpendicular to the stroke-valve axis 33.

If plunger piston 10 is plunged into the pressure space 29, the open stroke valve 1 (see FIG. 3) can be held in its opened position as a result of the pressure loading of the working fluid in the working space 11 counter to the pressure of the first spring 14 (helical compression spring 15) and a pressure possibly still prevailing in the pressure space 29 and counter to a force on the valve disc 6 possibly acting in the valve-closing direction.

The annular pressure-relief ducts 34 and 35 are located respectively above and below the working space 11 and are each connected via a connecting conduit 36 and 37 to a reservoir of the working fluid 38. The hydraulic connection between the connecting duct 31 and pressure relief duct 34 is controlled by a control groove 39 arranged in the valve stem 2, together with a control edge 40. In a similar way to this, the hydraulic connection between the connecting duct 32 and the annular pressure-relief duct 35 is made by a control groove 42 arranged in the valve stem 2, together with a control edge 44. The connecting ducts 31, 32 open into the respective control groove 39 and 42 at points 41, 43.

In the upper end position of the control piston 8, the oblique surface F3 is pressed against a seat S1 of the working space 11, with the result that the pressure space 28 is separated hydraulically from the working space 11 (see FIG. 1). Similarly, in the lower end position of the control piston 8, the oblique surface F4 is pressed against a seat S2 of the working space 11, with the result that the pressure space 29 is separated hydraulically from the working space 11 (see FIG. 3).

The functioning of the hydraulic valve control device according to the invention is hereafter described and explained by means of a work cycle.

The oil-pressure spring 17 and the control piston 8 form, together with the helical compression spring 15 and the stroke valve 1, a spring/mass system. In the absence of a supply pressure of the working fluid, the stroke valve 1 is always closed, since the valve disc 6 is pressed into the valve seat 7 by the prestressing force of the helical compression spring 15. When working fluid is being conveyed out of the reservoir 38 by means of the working-fluid pump (not shown), a supply pressure is built up and bears on the switching valve 27 via the pressure supply conduit 45. Irrespective of the switching position of the switching valve, the pressure loading of the conduit 26 with working fluid is guaranteed via the pressure supply conduit 45'.

The pressure is built up in the oil-pressure spring 17 via the conduit 26, the duct 25, the control groove 21 and the pressure ducts 20 and 19. The oil pressure spring 17 is thus tensioned. As a result of that position of the switching valve 27 shown in FIG. 1, the pressure in the working space 11 is likewise built up. The spring/mass system nevertheless remains in its upper end position (see FIG. 1), since the top side of the control piston 8 (plunger piston 9) is relieved by means of the connection of the pressure space 28 to the reservoir 38 of working fluid via the connecting duct 31 together with the annular pressure-relief duct 34 and connecting conduit 36. In contrast, the pressure in the working space 11 loads the corresponding hydraulic active surface on the control piston 8 (annular surfaces F5 and F6 perpendicular to the stroke-valve axis 33 and the annular surface F4 oblique relative to the latter) and brings about a resultant counterforce which presses the control piston 8 upwards. The stroke valve 1 therefore remains closed. When the switching valve 27 is activated, the working space 11 is separated from the pressure supply and is connected to the reservoir 38. The hydraulic active surface on the control piston 8 is thereby also relieved of pressure and the counterforce thus reduced. The control piston 8 together with the stroke valve 1 can then commence its oscillation from the upper end position into the lower.

When the plunger piston 9 has emerged completely from the pressure space 28 in the region of the upper end position of the control piston 8, the pressure space 28 and the pressure space 29 are connected to one another hydraulically via the working space 11. From this moment, the pressure in the working space 11 no longer has any influence on the behavior of the control piston 8 on account of the above-mentioned symmetry of the critical surfaces F1–F6 of the latter.

When the plunger piston 9 emerges from the pressure space 28, the valve stem 2, by means of its control edge 40, closes the hydraulic connection of the pressure space 28 to the annular pressure-relief duct 34. The switching valve 27 is then switched over and the working pressure 11 is put under pressure again. This action has no influence on the movement of the control piston 8. It must be guaranteed, however, that the pressure build-up in the working space 11 has been completed before the lower end position of the control piston 8 is reached, since the pressure in the working space 11 is then required in order to retain the spring/mass system in its lower end position.

Shortly before the lower end position of the control piston 8 is reached, the valve stem 2, by means of its control edge 44, opens the hydraulic connection between the connecting duct 32 and annular pressure relief duct 35. The plunger piston 10 closes the connection between the working space 11 and pressure space 29, the different pressures on the hydraulic active surfaces of the control piston 8 (plunger pistons 9/10) bringing about a resultant force on the control piston 8 in the valve-opening direction, the said force pushing the spring/mass system into its lower end position and retaining it there, with the result that the stroke valve 1 (see FIG. 3) remains opened.

The energy loss occurring during the movement cycle is compensated by a cyclic variation in the prestressing force of the oil-pressure spring. This takes place, in the lower end position of the spring/mass system, by the reduction of a still prevailing residual pressure in the oil-pressure spring 17 into the annular pressure-relief duct 34 via the pressure ducts 19 and 20 together with the control groove 21 (see FIG. 3). Thus, in the lower end position of the spring/mass system, the control edge 23 of the control groove 21 is located in the region of the annular pressure-relief duct 34.

During the return movement of the stroke valve 1 into its upper end position, the helical compression spring 15 thus prestressed to a greater extent than the oil-pressure spring 17 ensures that the upper end position is reached. At the same time, on account of the preceding reduction of residual pressure in the oil pressure spring 17, the latter can no longer be compressed to the original initial pressure. The resulting pressure difference is therefore compensated, in the upper end position of the spring/mass system (see FIG. 1), via the conduit 26 together with the duct 25, the control groove 21 and the pressure ducts 19, 20, 24 of the oil-pressure spring 17. This ensures that, at the commencement of the next work cycle, the oil-pressure spring 17 is prestressed to a greater extent than the helical compression spring 15. The energy supplied to the spring/mass system can be varied in the two end positions of the system independently of one another by variation in the pressures between which the oil-pressure spring 17 is operated. These pressure variations can be implemented by pressure-regulating arrangements (not shown) for the pressures prevailing in the pressure supply conduit 45 and in the reservoir 38.

By means of the valve control device according to the invention, conventional valve strokes along with control times of, for example, 5–10 milliseconds, with an energy consumption of approximately 100–250 watts (in the case of 50 valve openings per second), can be brought about without difficulty.

In a further version of the invention, the control of the conduit 26 can also take place via a further switching valve.

In the exemplary embodiment shown, the valve stem 2 together with the control piston 8 is made in one part, but the valve stem and control piston can, of course, also consist of two or more parts which either are fastened to one another by fastening means or are connected to one another by non-positive connection (for example, by being held together by pressure forces exerted by spring means) or by coupling means (for example, mechanical transmission).

In a further version of the invention, the periodic separation of the pressure spaces 28, 29 from the working space 11 can take place by means of conical or flat sealing seats which are formed between the pressure spaces 28 and 29 and the control piston 8. At the same time, for example the surfaces S1/F3 and S2/F4 could also be designed, instead of as a conical seat (as shown in the exemplary embodiment), also as a flat sealing seat. Both in the version with a conical seat and in the version with a flat sealing seat, the periodic separation of the pressure spaces 28, 29 can take place solely by means of these conical or flat sealing seats, with the result that the plunger piston according to the above exemplary embodiment is then omitted.

The above-described, freely activatable valve control device can be used for all controls of stroke valves, in particular for inlet and outlet valves of internal-combustion engines and piston compressors.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Hydraulic valve control device for a stroke valve, which valve control device is arranged in an internal-combustion engine, the stroke valve comprising a valve stem and a first spring acting on the valve stem in a valve-closing direction as well as a second spring acting at least periodically on said valve stem in a valve-opening direction, the valve stem being connected at least to a control piston which is arranged in a working space and can be loaded on two sides with a working fluid and by means of which, in a region of its end positions, in each case a pressure space belonging to the working space and separable hydraulically from the working space is partially limited, a pressure of the working fluid in the working space being regulatable via a pressure source together with a switching valve and a supply conduit and, in a region of at least one of two end positions of the control piston, the pressure space assigned to said at least one end position is capable of being relieved of pressure via a connecting duct, wherein the prestressing force of the second spring can be regulated while the valve control device is in operation and, with the working fluid relieved of pressure in the working space and with the second spring contracted, the first spring means holds the stroke valve in a closed position.

2. Hydraulic valve control device according to claim 1, wherein the energy loss occurring during a movement cycle can be compensated by a cyclic variation in the prestressing force of the second spring.

3. Hydraulic valve control device according to claim 1, wherein the second spring is an oil-pressure spring, the oil pressure of which can be regulated in the region of the end positions of the valve movement.

4. Hydraulic valve control device according to claim 3, wherein a residual pressure of the oil-pressure spring can be reduced via a pressure relief duct and a pressure build-up of the oil pressure of the oil-pressure spring can be controlled via a pressure duct which, with the stroke valve closed, is connected to the oil-pressure spring via a pressure duct arranged in the valve stem.

5. Hydraulic valve control device according to claim 1, wherein the control piston comprises two plunger pistons of which one plunger piston is assigned in each case to one of the two pressure spaces and can plunge into same, the control piston being designed in such a way that, after one of the two plunger pistons has emerged from the associated pressure space the working space and the two pressure spaces are hydraulically connected to one another.

6. Hydraulic valve control device according to claim 1, wherein the periodic separation of the pressure spaces from the working space takes place by means of conical or flat sealing seats which are formed between the pressure spaces and and the control piston, the periodic separation of the pressure spaces taking place solely by means of these conical or flat sealing seats.

7. Hydraulic valve control device according to claim 5, wherein the hydraulic connection of the two pressure spaces is formed by the working space itself.

8. Hydraulic valve control device according to claim 1, wherein the hydraulically active surfaces of the control piston are of equal size in the valve-opening direction and in the valve-closing direction in a position lifted off from its respective end positions.

9. Hydraulic valve control device according to claim 1, wherein, with the plunger piston plunged into the pressure space, the open stroke valve can be held in its opened position by the pressure loading of the working fluid in the working space counter to the pressure of the first spring means, counter to the pressure in the pressure space and counter to forces possibly acting on the valve disc in the closing direction.

10. Hydraulic valve control device according to claim 1, wherein with the plunger piston plunged into the pressure space, the closed stroke valve can be held in its closed position by the pressure loading of the working fluid in the working space counter to the pressure of the second spring and counter to the pressure in the pressure space as well as counter to forces possibly acting on the valve disc in the opening direction.

11. Hydraulic valve control device according to claim 2, wherein the second spring means is an oil-pressure spring, the oil pressure of which can be regulated in the region of the end positions of the valve movement.

12. Hydraulic valve control device according to claim 11, wherein a residual pressure of the oil-pressure spring can be reduced via a pressure relief duct and a pressure build-up of the oil pressure of the oil-pressure spring can be controlled via a pressure duct which, with the stroke valve closed, is connected to the oil-pressure spring via a pressure duct arranged in the valve stem.

13. Hydraulic valve control device according to claim 12, wherein the control piston comprises two plunger pistons, of which one plunger piston is assigned in each case to one of the two pressure spaces and can plunge into same, the control piston being designed in such a way that, after one of the two plunger pistons has emerged from the associated pressure space, the working space and the two pressure spaces are hydraulically connected to one another.

14. Hydraulic valve control device according to claim 12, wherein the periodic separation of the pressure spaces from the working space takes place by means of conical or flat sealing seats which are formed between the pressure spaces and and the control piston, the periodic separation of the pressure spaces taking place solely by means of these conical or flat sealing seats.

15. Hydraulic valve control device according to claim 14, wherein the hydraulic connection of the two pressure spaces is formed by the working space itself.

16. Hydraulic valve control device according to claim 15, wherein the hydraulically active surfaces of the control piston are of equal size in the valve-opening direction and in the valve-closing direction in a position lifted off from its respective end positions.

17. Hydraulic valve control device according to claim 16, wherein, with the plunger piston plunged into the pressure space, the open stroke valve can be held in its opened position by the pressure loading of the working fluid in the working space counter to the pressure of the first spring, counter to the pressure in the pressure space and counter to forces possibly acting on the valve disc in the closing direction.

18. Hydraulic valve control device according to claim 17, wherein with the plunger piston plunged into the pressure space, the closed stroke valve can be held in its closed position by the pressure loading of the working fluid in the working space counter to the pressure of the second spring and counter to the pressure in the pressure space as well as counter to forces possibly acting on the valve disc in the opening direction.

19. Hydraulic valve assembly for internal combustion engine inlet and outlet openings, comprising:

a valve stem connected to a valve, a first spring continuously pushing the valve stem toward a valve closing position, a second spring periodically pushing the valve stem toward a valve opening position, and a control piston connected to the valve stem and operable to be selectively hydraulically moved by working fluid toward respective valve opening and closing positions, wherein the prestressing force of the second spring is controllable to assist valve opening movement of the control piston and operable such that, when the working fluid is relieved of pressure and the second spring is contracted, the first spring holds the valve stem in a valve closed position.

20. Hydraulic valve assembly according to claim 19, wherein the second spring is an oil-pressure spring, the oil pressure of which can be regulated in the region of the end positions of the valve movement.

* * * * *